United States Patent [19]

Numbers

[11] Patent Number: 4,489,515

[45] Date of Patent: Dec. 25, 1984

[54] CONCEALABLE FIREARM

[76] Inventor: Jody L. Numbers, 7908 E. Oak, Scottsdale, Ariz. 85257

[21] Appl. No.: 477,263

[22] Filed: Mar. 21, 1983

[51] Int. Cl.[3] ..... F41C 3/00; F41C 9/00; F41C 19/00

[52] U.S. Cl. ..... 42/1 R; 42/40; 42/41; 42/69 R

[58] Field of Search ..... 42/1 R, 1 G, 40, 41, 42/69 R

[56] References Cited

U.S. PATENT DOCUMENTS 1,637,079 7/1927 Karner, Jr. ..... 42/1 G

*Primary Examiner*—Charles T. Jordan
*Assistant Examiner*—Ted L. Parr
*Attorney, Agent, or Firm*—Drummond & Nissle

[57] ABSTRACT

An improved firearm. The width of the firearm does not exceed the minimum barrel size which will safely contain the chamber pressure of its designated caliber of ammunition. The firearm is further shaped, contoured and constructed for ready concealment on the person of a law enforcement officer. The side surfaces of the firearm are formed so that the purchase or "frictional forces" between the side surfaces and the body or clothing of a law enforcement officer tend to maintain the firearm in the desired position on the person of the officer. A special trigger-hammer mechanism prevents the gun from discharging if accidentally impacted or dropped and said trigger-hammer mechanism also requires that the hammer-firing pin be poised for firing by pulling the trigger, thus not allowing the firearm to be "cocked", further preventing an accidental discharge if the weapon is jostled while unattended.

1 Claim, 11 Drawing Figures

CONCEALABLE FIREARM

This invention relates to firearms.

More particularly, the invention relates to a firearm in which cartridges are manually loaded into a chamber formed integrally with the barrel of the gun.

In another respect, the invention relates to a firearm in which the width from one side to the other side of the firearm is substantially constant over the entire firearm such that all parts of the gun lie within an envelope defined by two spaced parallel imaginary planes.

In a further respect, the invention relates to a firearm which is readily concealed on the person of a law enforcement officer.

In still another respect, the invention relates to a firearm in which the substantial majority of the surface area on each side of the barrel and handle of the firearm lies upon the same imaginary plane.

In yet another respect, the invention relates to a firearm which, when laid on a flat surface on its side, is not readily tipped or rotated by applying a downward pressure against the trigger or other portion of the gun.

In still yet another important respect, the invention pertains to a firearm which cannot be inadvertently discharged if the firearm is accidentally dropped or struck against a surface.

In a further and equally important respect, the invention relates to a firearm wherein the hammer and firing pin can only be poised for firing by the user pulling the trigger rearward, preventing the weapon from being carried or stored in a "cocked" condition, thus preventing an accidental discharge while the weapon is unattended.

Derringers and other small sized firearms are well known in the art and have long been utilized by law enforcement officers as a "second weapon", or "backup", which could be concealed on a person's body and utilized in case of emergency.

A weapon which can be effectively concealed is most valuable to an undercover police officer who has infiltrated a group suspected of illegal activity. Because of this hostile environment, most officers prefer to be armed, but are required to be unarmed by the suspects under surveillance. If the officer is discovered to be covertly armed, it could be life threatening.

An individual experienced in searching others or "frisking" for weapons uses his tactile senses to locate unnaturally protruding shapes on the body of a person. Therefore, the size and shape of a w eapon is critical to concealability.

The disadvantage of prior art weapons is that the frame, handle and other protruding features are usually thicker than the barrel, resulting in a shape which is irregular and rotund. As a result, the particular rotund characteristics of prior art weapons will prevent effective concealment on a law enforcement officer who is being searched.

In designing small weapons, the prior art has only focused on providing the maximun comfort to the users hand while firing the weapon and tactile access to the various mechanical controls required to operate the weapon. Often aesthetic or cosmetic consideration has been given design priority, particularly to the size and shape of the handle, resulting in the aforementioned rotund shape of prior art weapons.

Heretofore, firearm designers have not concentrated their efforts on concealability, reducing and confining the mechanism within a narrow, thin envelope with the maximum width determined by the minimum amount of material around the barrel which will safely contain the chamber pressure of the particular ammunition designated for the weapon. Thus, the width of the weapon would be as thin as possible for its designated ammunition and provides the maximum possibility of effective concealability for a weapon of its particular caliber.

Length and height are important factors in designing a readily concealable gun, but the width and surface contour of a gun and the ability to concentrate the firing mechanism and other mechanical functions within a very narrow space appears to be more important in developing such a gun. A playing card is much more readily hidden up a sleeve than a snubnose .38, and both are of approximately the same length.

Accordingly, it would be highly desirable to provide an improved firearm which would be shaped, contoured and dimensioned to provide the maximum frictional contact between the firearm and body or clothing of a law enforcement officer so as to facilitate the firearm's remaining fixed in the desired position on the body of the officer.

It would also be highly desirable to provide an improved firearm which could be readily concealed on the person of a law enforcement officer and would be difficult to detect during frisking of the officer.

Therefore, it is a principal object of the invention to provide an improved firearm.

Another object of the invention is to provide an improved firearm in which cartridges are manually loaded into a chamber formed integrally with the barrel of the firearm, the barrel being pivotally connected to the frame of the gun.

A further object of the invention is to provide an improved firearm in which the width of the firearm from one side to the other side of the firearm is substantially constant such that all mechanisms and parts of the gun lie within an envelope defined by two spaced, parallel imaginary planes.

Still another object of the instant invention is to provide an improved firearm which is readily concealed on the person of a law enforcement officer and is difficult to detect during frisking of the law enforcement officer.

Yet another object of the invention is to provide an improved firearm in which the substantial majority of the surface area on each side of the firearm is shaped, contoured and dimensioned such that the frictional contact between the sides of the firearm and the body of clothing of an individual tend to maintain the firearm in the desired position when concealed on the individual.

Yet still a further object of the invention is to provide an improved firearm which, when laid on its side on a flat surface, does not readily tip or move when a torque producing force is applied to the trigger or other portion of the gun.

Another object of the invention is to provide an improved manually loaded firearm which cannot be inadvertently discharged by dropping or accidentally striking the firearm against an object.

These and other, further and more specific objects and advantages of the invention will be apparent to those skilled in the art from the following detailed description thereof, taken in conjunction with the drawings, in which.

Briefly, in accordance with my invention, I provide an improved firearm. The firearm includes a frame including a handle portion and having at least two generally parallelably opposed spaced members defining in part first and second side surface areas of the firearm and an internal space therebetween, the spaced opposed members generally lying in a pair of opposed, spaced, parallel imaginary planes; a barrel pivotally connected to said frame and having a chamber for receiving a cartridge, having a bore through which a bullet fired from the cartridge travels, and, movable between at least two operative positions, a first operative position in which the firearm can be fired, and a second operative position in which a cartridge can be manually loaded into the chamber; a hammer pivotally carried on the frame in the internal space thereof; a trigger carried on the frame and operatively associated with the hammer, the trigger being manually depressed to pivotally spring load and release the hammer; spring means mounted on the frame and operatively associated with the hammer; and firing pin means carried on the hammer, the hammer and firing pin means being movable between at least two operative positions, a normal operative position with the hammer at rest in a state of equilibrium with the trigger and the spring means, and an operative position and maintained by the trigger in a cocked position with the spring means compressed such that after the trigger releases the hammer, the compressed spring means forces the hammer to pivot on the frame such that the firing pin means strikes and fires a cartridge carried in the chamber. The chamber has a cylindrically shaped inner wall and the barrel and handle portion have surfaces defining in part the first and second side surface areas of the firearm, the barrel and handle surfaces generally lying in the opposed imaginary planes with the spaced members of the frame. The barrel has a minimum barrel wall thickness represented by the shortest distance from the cylindrical wall of the chamber to any of the surfaces defining the first and second side surface areas of the firearm. The shortest distance between the imaginary planes represents the greatest width of the firearm and is equivalent to the diameter of the inner cylindrical wall of the chamber added to twice the minimum barrel wall thickness. The minimum barrel wall thickness is generally the minimum thickness which can be utilized to prevent damage to the barrel when the firearm is fired.

Figure 1:
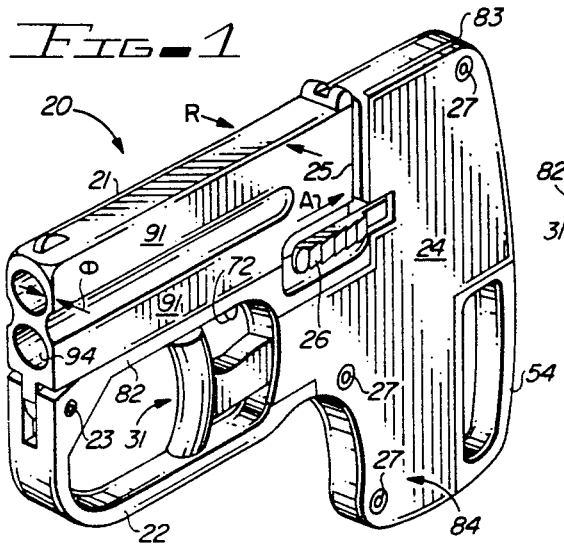
FIG. 1 is a perspective view of a firearm constructed in accordance with the principles of the invention.
Figure 3:
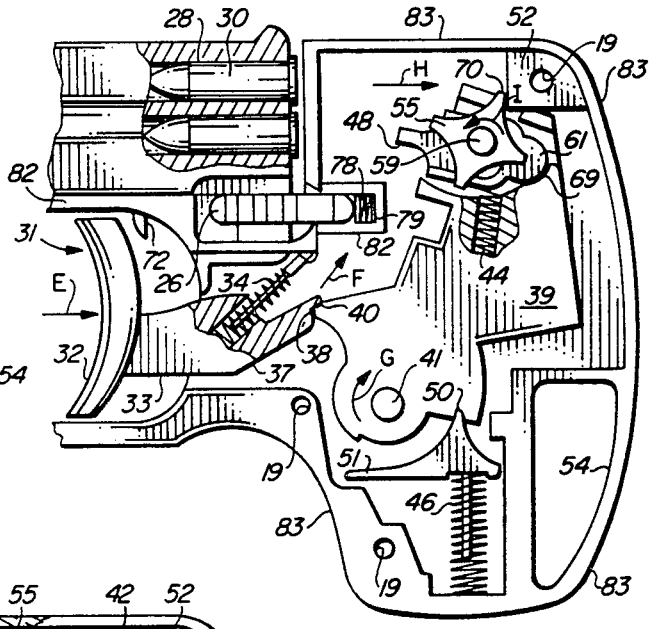
FIG. 3 is a partial view of the firearm of FIG. 2 illustrating the mode of operation thereof.
Figure 2:
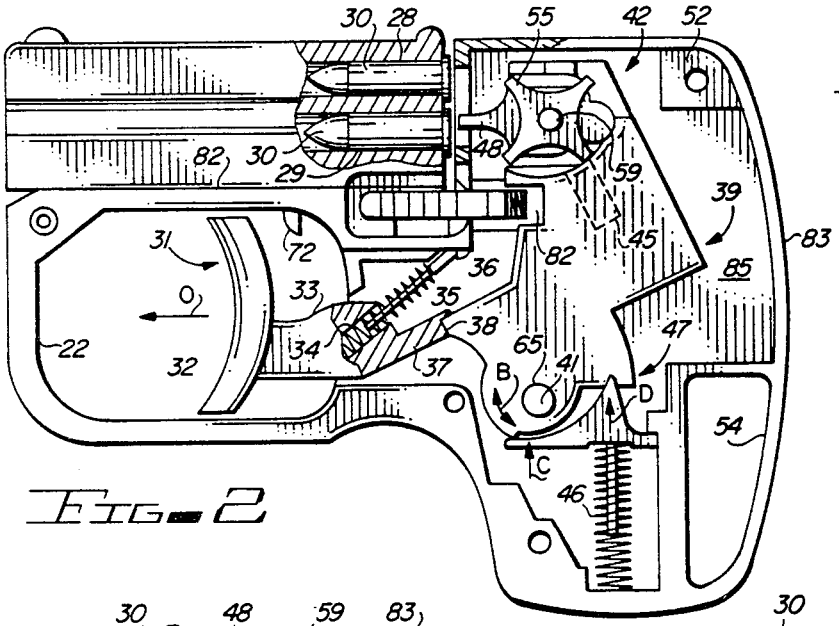
FIG. 2 is a side view of the firearm of FIG. 1 with the handle cover plate removed and a portion of the barrel broken away to further illustrate the interior construction of the firearm.

Turning now to the drawings, which depict the presently preferred embodiments of the invention for the purpose of illustrating the practice thereof and not by way of limitation of the scope of the invention and in which like reference characters represent corresponding elements throughout the several views, FIGS. 1-11 represent a firearm constructed in accordance with the principles of the invention and generally indicated by reference character 20. Firearm 20 includes frame members 82, 83, 22 and barrel 21 pivotally attached to trigger guard 22 by pin 23. A spring (not visible) adjacent pin 23 causes end 25 of barrel 21 to rotate upwardly when barrel release latch 26 is moved in the direction of arrow A. Side plate 24 on the front side of firearm 20 can, as indicated in FIG. 3, be removed to expose the hammer and firing pin mechanisms of the gun. Plate 24 is taken off by removing screws 27 from internally threaded apertures 19. In FIGS. 2-5, side panel 24 is removed. As shown in FIG. 2, cartridge chambers 28 are formed integrally with barrel 21 and receive cartridges 30. Before gun 20 is used to fire one of cartridges 30, trigger 31 is positioned as shown in FIG. 2. Trigger 31 includes curved finger rest 32 and depending backwardly projecting arm 33 having aperture 34 which receives spring 35. One end of spring 35 is maintained in aperture 34 while the other end fits around and is maintained in position by pin 36. Notch 38 in finger 37 engages point 40 of hammer 39. Hammer 39 rotates about pivot rod 41 as indicated by arrows B in FIG. 2. Pin 41 is fixedly secured to panel 85. Cycling trigger assembly 42 is carried on the upper part of hammer 39 and includes a spring 44 compressed in aperture 45 formed in hammer 39. Spring 46 and shoe 47 impart the upward forces indicated by arrows C, D against hammer 39 to maintain the hammer in the equilibrium position shown in FIG. 2. Force D is greater than force C, but shoe 47 is shaped and dimensioned such that force C is sufficient to maintain trigger point 48 spaced back and away from the exposed ends of cartridges 30. Ankle 50 and toe 51 of foot 47 impart forces C and D respectively to hammer 39. Tooth 52 interacts with trigger assembly 42 during operation of firearm 20. Aperture 54 formed in the frame of firearm 20 enables a lanyard to be secured to firearm 20.

Figure 5:
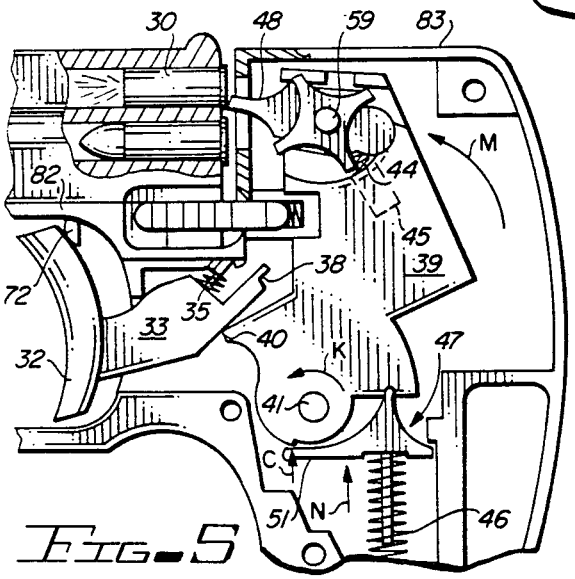
FIG. 5 is a partial view of the firearm of FIG. 2 illustrating the position of the trigger, hammer and firing pin mechanism when the gun is being fired.
Figure 6:
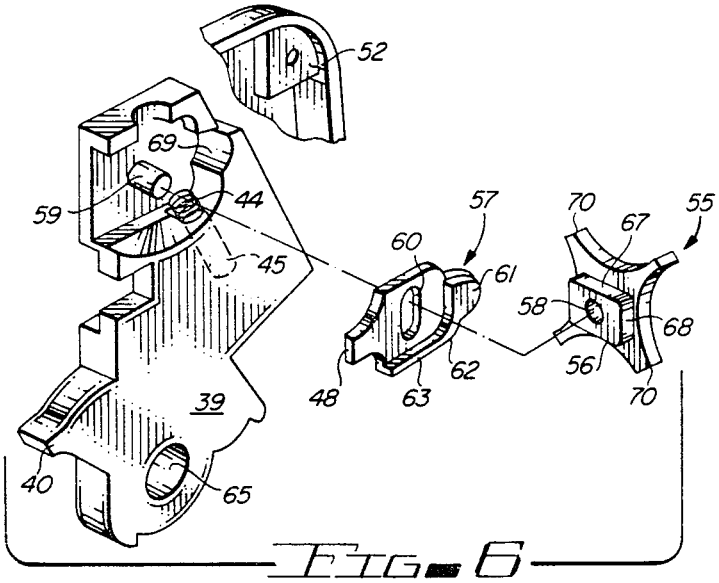
FIG. 6 is an exploded assembly view of the alternating firing pin mechanism of the firearm of FIGS. 2-5.

FIG. 6 illustrates an assembly view of the hammer 39 and firing pin assembly 42 including star 55 having a rectangular cam 56 on the back thereof. Circular aperture 58 passes through cam 56 and star 55. Firing pin member 57 includes firing pin 48, elongate aperture 60 passing therethrough, elbow 61, and lip 63 having bottom edge 62. Compressed spring 44 continually exerts an upward force against bottom edge 62 of lip 63. Pin 59 fixedly attached to hammer 39 passes through apertures 60 and 58 when the firing pin mechanism 42 is assembled as shown in FIGS. 2-5. As long as star 55 is not being rotated about pin 59 of hammer 39, one of the long edges 67 or short edges 68 of cam 56 rides on top of edge 63 of firing pin member 57. Curved elbow 61 of firing pin member 57 is received by and pivotally rests in radial groove 69 of hammer 39. As will be described, the interaction of tooth 52 with the points 70 of star 55 during repeated firing of weapon 20 causes elbow 61 of firing pin member 57 to rotate in radii 69 and aperture 60 to slide up and down on pin 59 so that firing pin 48 is moved between two operative positions. In one operative position, firing pin 48 strikes upper cartridge 30 while in the other operative position trigger 48 strikes the bottom of the lower cartridge 30.

The operation of the trigger 31, hammer 39 and firing pin mechanism 42 of the gun will now be described with reference to FIGS. 2-5. In FIG. 2, the gun 20 is pictured prior to an individual's beginning to depress trigger 31 to fire the gun. In FIG. 3, the individual has grasped finger hold 32 and begun depressing trigger 31 in the direction of arrow E. As trigger 31 is depressed, notch 38 of finger 37 moves edge 40 of hammer 39 upwardly in the direction of arrow F. As corner 40 rotates upwardly, hammer 39 rotates about pin 41 in the direction of arrow G and firing pin mechanism 42 moves in the direction of arrow H in FIG. 3. As firing pin mechanism 42 moves in the direction of arrow H, the tip of tooth 52 engages one of tips 70 of star 55 causing star 55 to rotate 90° about pin 59. In FIG. 2, one of the short sides 68 of rectangular cam is engaging lip 63 of firing pin component 57 so that firing pin 48 is positioned in the lower operative position. As one of tips 70 of star 55 is contacted by tooth 52 and star 55 rotates about pin 59 in the direction of arrow I in FIG. 3, one of the long edges 67 of rectangular cam 56 comes into contact with lip 63. When one of the long edges 67 of cam 56 is in contact with lip 63, firing pin 48 is in its upper position and will, when gun 20 is fired as shown in FIG. 5, contact upper cartridge 30.

Each time trigger 31 is depressed and gun 20 fired, star 55 is rotated approximately 90° when one of fingers 70 contacts and is rotated by tooth 52.

Figure 4:
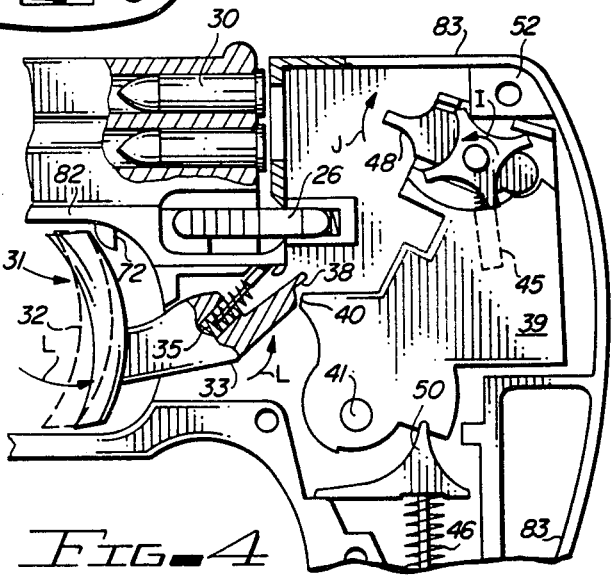
FIG. 4 is a partial view of the firearm of FIG. 2 further illustrating the internal working mechanisms thereof at the instant just prior to firing of the gun.

FIG. 4 illustrates the position of the trigger 31, hammer 39, and firing pin 48 just prior to the instant slot 38 disengages from edge 40 of hammer 39 and compressed spring 46 rotates hammer 39 about pin 41 in the direction of arrow K. After trigger 31 has been depressed through the position shown in FIG. 3 to the position of FIG. 4, star 55 has been rotated 90° and one of long edges 67 of rectangular cam 56 is contacting and resting on edge 63 of trigger member 57. The rotation of a long edge 67 of cam 56 into contact with edge 63 causes firing pin 48 to be upwardly displaced in the direction of arrow J from the first operative position shown in FIG. 2 to a second operative position. FIG. 4 depicts how the upper portion of finger hold 32 contacts member 72 and causes finger hold 32 and arm 33 to pivot thereabout in the direction indicated by arrow L. The pivoting of trigger 31 about member 72 causes notch 38 of arm 37 to move upwardly and disengage from edge 40 of hammer 39, releasing hammer 39 to move in the direction of arrow M in FIG. 5.

The instant gun 20 is fired is depicited in FIG. 5. In FIG. 5, spring 46 has upwardly displaced shoe 47 and caused hammer 39 to rotate in the direction of arrow M so that firing pin 48 contacts and fires upper shell 30. Immediately after firing pin 48 has contacted shell 30, force C generated against hammer 39 by toe 51 of shoe 47 causes hammer 39 to slightly rotate in a direction opposite that of arrow M so that firing pin 48 is backed away from upper cartridge 30 a distance equal to the distance between pin 48 and cartridge 30 in FIG. 2. In addition, immediately after firing pin 48 has contacted whell 30, compressed spring 35 forces arm 33 and finger rest 32 of trigger 31 back to the position shown in FIG. 2 with notch 38 of arm 33 engaging edge 40 of hammer 39. When trigger 31 is in the rest position shown in FIG. 2, the chances of gun 20 being accidentally fired without compressing trigger 31 are greatly minimized, if not entirely eliminated, since when gun 20 is accidentally struck or dropped against a surface in such a manner as to impart a force to hammer 39 which might cause firing pin 48 to be forwardly moved against one of cartridges 30, trigger 31 prevents the forward movement of hammer 39. Trigger 31 prevents the forward movement of hammer 39 because on the back side of arm 33 there is a downwardly projecting lip (not visible) which engages an opposed upwardly projecting lip (not visible) formed on panel 85 underneath arm 33 as viewed in FIGS. 2-4. The effect of these two engaging lips is to prevent the trigger 31 from being moved in the direction of arrow O when trigger 31 is in the rest position shown in FIG. 2. These two engaging lips do not, of course, prevent the trigger from being depressed as illustrated in FIGS. 3-5.

FIGS. 7-11 illustrate how latch 26 is operated to release barrel 21. Barrel 21 includes foot 74 having outwardly depending toe 75 and nipple 76. Aperture 77 formed in the gun housing receives nipple 76 when barrel 21 is in the closed position shown in FIG. 7. One end of barrel release latch 26 is received in aperture 79 against compressed spring 78. When barrel 21 is closed, lip 80 of latch 26 engages the top of toe 75 and prevents barrel 21 from moving upwardly in the direction of arrow P in FIG. 8. When latch 26 is moved in the direction of arrow A in FIGS. 1 and 8, lip 80 is disengaged from toe 75 and barrel 21 is displaced upwardly in the direction of arrow P by a spring (not visible) positioned adjacent pivot pin 23.

Figure 10:
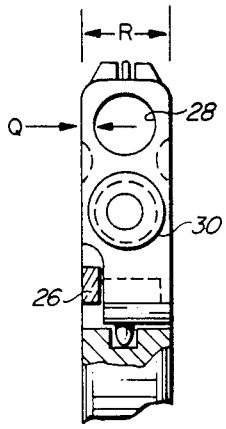
FIG. 10 is a sectional view of the firearm of FIG. 7 taken along section line 10—10 thereof and illustrating the cartridge chambers thereof.
Figure 7:
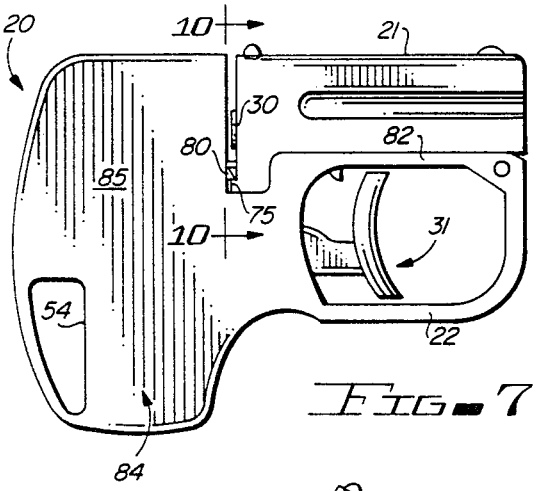
FIG. 7 is a back view of the firearm of FIG. 1.
Figure 9:
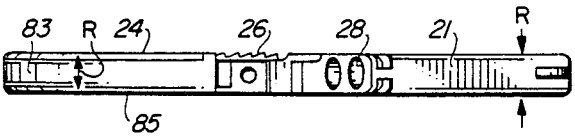
FIG. 9 is a top view of the firearm of FIG. 8.

In FIGS. 1, 9, 10 the maximum width of firearm 20 is indicated by arrows R. Firearm 20 does not exceed this width at any point and all components of firearms 20 lie within a pair of imaginary, opposed, spaced parallel planes passing through panels 24, 85 respectively.

Figure 11:
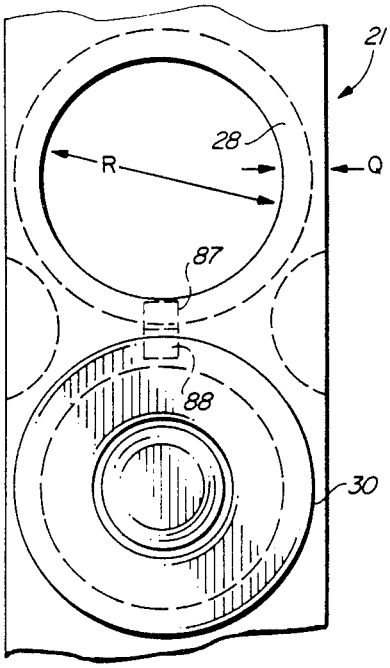
FIG. 11 is an enlarged view of the cartridge chambers of FIG. 10.

If FIGS. 10 and 11, the minimum wall thickness of chamber 21 is indicated by arrows Q. The diameter D of chamber 28 is indicated by arrows R in FIG. 11. The maximum width of firearm 20 indicated by arrows R is generally equivalent to the diameter D of chamber 28 added to twice the minimum wall thickness indicated by arrow Q. The minimum wall thickness represents the minimal thickness of material necessary so firearm 20 can be safely utilized to fire at least one cartridge 30 without breeching, cracking or otherwise substantially damaging barrel 21 such that further use of firearm 20 is prevented. A firearm having a barrel 21 provided with a satisfactory minimum barrel wall thickness can be safely fired at least once. However, in the practice of the invention, the appropriate minimum barrel wall thickness can vary between the thickness necessary to permit firearm 20 to be fired at least once to the wall thickness necessary to safely repeatedly utilize the weapon for any desired period of time. By way of example, the presently preferred embodiment of the invention shown in the drawings is constructed to utilize a rim-fired .22 cartridge and has a width indicated by arrows R of approximately five-sixteenths of an inch and has a minimum barrel wall thickness indicated by arrows Q of approximately 0.035 of an inch.

Figure 8:
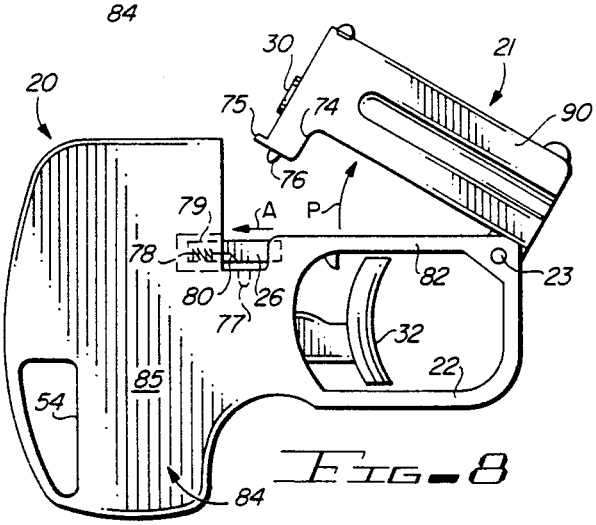
FIG. 8 is a back view of the firearm of FIG. 1 illustrating the release of the barrel thereof to insert or remove a cartridge.

As shown in FIG. 8, the coplanar vertical surface area of one side of firearm 20 includes panel surface area 85, the vertical surface area of trigger guard 22 and member 83 and the vertical side surface area 90 of barrel 21. The coplanar surface area on the opposite side of firearm 20 is pictured in FIG. 1 and includes the vertical surface area of panel 24, vertical surface areas on trigger guard 22 and member 82, and surface area 91 on barrel 21. If desired, indentations could be formed in panels 24, 85; however, the substantial amount of continuous coplanar surface area on the sides of firearm 20 provides a large measure of frictional contact between the firearm and the skin or clothing of an individual.

The side surfaces of firearm 20 may be indented or otherwise shaped, contoured and dimensioned so the side surfaces will tend to grip and not slide or slip over the skin or clothing of an individual. The side surfaces could be provided with a layer of textured or non-slip material which would adhere to the skin or clothing of an individual.

In many firearms the diameter of the chamber, indicated by arrows R in FIG. 11, is generally equivalent to the outside diameter of the grooved rifling of bore 94 of the barrel. The inside diameter or diameter inscribed by the upstanding slightly helical ridges of the grooves formed in the bore is less than the diameter of the chamber and of the cartridge bullet so that the helical ridges "bite" and impart spin to the bullet as it passes through the bore. In some firearms, for instance in a .45 A.C.P. caliber pistol, the diameter of the chamber may be slightly larger than the outside diameter of the rifling. When the term minimum barrel wall thickness was defined above, the shortest distance from the cylindrical chamber wall to the side of the barrel was, of course, utilized.

When firing pin 48 is in the position shown in FIG. 5, it strikes the upper cartridge 30 on the rim at a location indicated by dashed area 87 in FIG. 11. When pin 48 is in the lower position indicated in FIG. 2, it contacts the rim of lower cartridge 30 at the position indicated by dashed area 88 shown in FIG. 11.

Having described my invention in such terms as to enable those skilled in the art to understand and practice it, and having identified the presently preferred embodiment and best mode thereof, I claim:

1. A firearm comprising

(a) a frame including a handle portion and having at least two generally parallelably opposed spaced members defining (i) in part first and second side surface areas of said firearm, and (ii) an internal space therebetween, said spaced opposed members generally lying in a pair of opposed, spaced, parallel imaginary planes, (b) a barrel pivotally connected to said frame and (i) having a chamber for receiving a cartridge, said chamber having a cylindrically shaped inner wall, (ii) having a bore through which a bullet fired from said cartridge travels, and (iii) movable between at least two operative positions, first operative position in which said firearm can be fired, and a second operative position in which a cartridge can be manually loaded into said chamber;

(c) a hammer pivotally carried on said frame and at least partially positioned in said internal space;

(d) a trigger carried on said frame and operatively associated with said hammer, said trigger being manually depressed to pivotally displace and release said hammer;

(e) spring means mounted on said frame and operatively associated with said hammer;

(f) firing pin means carried on said hammer, said hammer and firing pin means being movable between at least two operative positions, (i) a normal operative position with said hammer at rest in a state of equilibrium with said trigger and said spring means, and (ii) an operative position with said hammer pivotally displaced from said normal operative position and maintained by said trigger in a cocked position such that after said trigger releases said hammer, said compressed spring means forces said hammer to pivot on said frame such that said firing pin means strikes and fires a cartridge carried in said chamber;

said barrel and handle portion having surfaces defining in part said first and second side surface areas of said firearm, said barrel and handle surfaces generally lying in said opposed imaginary planes with said spaced member of said frame, said barrel having a minimum barrel wall thickness represented by the shortest of the distances from said cylindrical wall of said chamber to said surfaces defining said first and second side surface areas of said firearm, the shortest distance between said imaginary planes representing the greatest width of said firearm and being equivalent to the diameter of said inner wall of said chamber added to twice said minimum barrel wall thickness, said minimum barrel wall thickness generally being at least sufficient to prevent significant damage to the barrel when said firearm is fired for the first time, said significant damage to the barrel preventing further use of said firearm.

* * * * *